United States Patent [19]

Coleman

[11] Patent Number: 4,842,279

[45] Date of Patent: Jun. 27, 1989

[54] INDICATING DEVICE

[76] Inventor: Benny R. Coleman, 102 W. Oak St., Nicholasville, Ky. 40356

[21] Appl. No.: 248,590

[22] Filed: Sep. 26, 1988

[51] Int. Cl.[4] ..... A63B 69/36

[52] U.S. Cl. ..... 273/183 A; 273/143 B; 273/55 B; 273/184 B

[58] Field of Search ..... 273/183 A, 184 B, 184 R, 273/185 C, 185 D, 185 R, 55 B, 143 B

[56] References Cited

U.S. PATENT DOCUMENTS

| | | | |
|---|---|---|---|
| 2,861,141 | 11/1958 | De Brocke | 273/183 A |
| 3,992,011 | 11/1976 | Jessee | 273/183 A |
| 4,000,904 | 1/1977 | Poortman | 273/183 A |

*Primary Examiner*—George J. Marlo

*Attorney, Agent, or Firm*—Frank C. Leach, Jr.

[57] ABSTRACT

When a golfer strikes a ball on a tee connected to a latch release for a pivotally mounted arm, the arm is accelerated by a preloaded torsion spring from an inactive (vertical) position to an indicating (horizontal) position in which an opening in the arm is disposed on the same line of sight from the golfer as the tee. An endless tape, which is supported by the arm, has a number appearing in the opening for a short, selected period of time after the arm reaches its indicating position. The opening is blocked by a slide after the selected period of time has elapsed so that the golfer will not see the number if the golfer fails to maintain eye contact with the ball impact area after striking the ball on the tee. When the arm is returned to its inactive position, the number on the tape can be viewed from the opposite side of the arm having the opening so that the golfer can ascertain if the number was viewed. Advancement of the tape, as the arm is returned to its inactive position, disposes another number at the opening for viewing when the arm is next moved to its indicating position by another ball on the tee being struck.

18 Claims, 5 Drawing Sheets

INDICATING DEVICE

This invention is shown and described in Disclosure Document No. 167,066.

This invention relates to a device for indicating whether a person striking a ball continues to look at the ball impact area until after the ball is struck and, more particularly, to a non-electrical device to enable a person striking a ball to determine if eye contact is maintained at the point of striking the ball until after the ball is struck.

In various sports in which a ball is struck by a person, the person striking the ball must maintain eye contact with the ball until after the ball is struck. If a golfer, for example, fails to maintain such eye contact, proper striking of the ball does not occur.

In order for the golfer to know that eye contact is continued until after the ball is struck by the golf club head, one means for enabling the golfer to ascertain this is to provide an indicator that appears in the ball impact area after the ball is struck. Two previously suggested devices for accomplishing this are shown in U.S. Pat. Nos. 3,992,011 to Jessee and 4,000,904 to Poortman.

The device of each of the aforesaid Jessee and Poortman patents utilizes a lamp through a randomly selected color glass to provide the signal. Thus, each of these devices requires a power source such as a battery, for example, to energize the lamp. This has the disadvantages of the battery or lamp failing, its replacement at an inconvenient time during use, and additional cost for the lamp and battery. Another disadvantage of the device of each of the aforesaid Jessee and Poortman patents is that it is difficult for a golfer to determine if the lamp is lit when used in bright sunlight.

Furthermore, the device of the aforesaid Jessee patent has the lamp remain energized after the ball is struck by the golfer without the lamp being interrupted after a short period of time. Thus, if a golfer's head were to be raised quickly and then returned quickly to have eye contact at the point of impact of the golf club head with the ball, the golfer would see the randomly selected color because the lamp is still energized since the color does not change after the golfer strikes the ball. Accordingly, the golfer could be misled by the device of the aforesaid Jessee patent into believing that eye contact had been maintained until after impact of the golf club head with the ball whereas eye contact had been momentarily interrupted at the time of impact of the golf club head with the ball. Therefore, the aforesaid Jessee device would mislead the golfer into believing that eye contact with the ball impact area was maintained for the entire time period.

The device of the aforesaid Poortman patent avoids this disadvantage of the device of the aforesaid Jessee patent in that the lamp is activated for only a very short period of time after impact of the golf club head with the ball. However, in addition to requiring the battery for energizing the lamp, the device of the aforesaid Poortman patent also requires a mechanism for driving a gear train to randomly position one of a plurality of colored windows beneath an opening in a cover plate. This mechanism and the gear train substantially increase the cost of the device.

The device of the aforesaid Poortman patent also requires the golfer to depress a vertically movable activating shaft to ascertain that the correct color was viewed at the time of striking the ball. Because the shaft also is depressed when another ball is placed on the tee but a further distance than when ascertaining the color when there was a prior striking of a ball, the possibility exists that another ball may be positioned on the tee before the golfer depresses the tee slightly to see the color at the time of the previous ball being struck. If this were to occur, the golfer would not know whether eye contact had been maintained during ball impact.

The device of each of the aforesaid Jessee and Poortman patents has the mechanism, which is responsive to the ball being struck, in the ball striking area. As a result, if the golfer undercuts the ball, the golf club head can strike the ball responsive mechanism and damage or destroy it.

The indicating device of the present invention satisfactorily overcomes the problems of the aforesaid Jessee and Poortman patents. The indicating device of the present invention does not require any power source, a lamp, or a powered mechanism for driving a gear train. The indicating device of the present invention is solely a mechanical device. The main mechanism of the indicating device of the present invention is remote from the ball striking area.

Furthermore, the indicating device of the present invention avoids the possibility of an indicator, which is viewable in the ball impact area for only a short period of time after the ball is struck, not being capable of being checked after another ball is placed on the tee. This is because the indicator, which was viewable in the ball impact area for only the short period of time after the ball was struck, can be viewed in another location by the golfer at any time until another ball is struck and without any movement of the device by the golfer other than returning the device to its inactive position.

The indicating device of the present invention has movable means movable from its inactive position to its indicating position when a ball is struck. When the movable means reaches its indicating position, an indicator is viewable for a short selected period of time. When the movable means is returned to its inactive position, the indicator, which was viewable for the short selected period of time after the ball was struck when the movable means was in its indicating position, is continuously viewable at another location by the golfer until another ball is struck. This enables the golfer to determine whether eye contact was maintained with the ball impact area throughout the time of striking the ball and until shortly thereafter.

An object of this invention is to provide a device to aid in keeping a person's head down when striking a ball until after impact.

Another object of this invention is to provide a mechanical device for use in teaching a person to maintain eye contact with a ball impact area until after a ball is struck.

Other objects of this invention will be readily perceived from the following description, claims, and drawings.

The attached drawings illustrate a preferred embodiment of the invention, in which.

Figure 1:
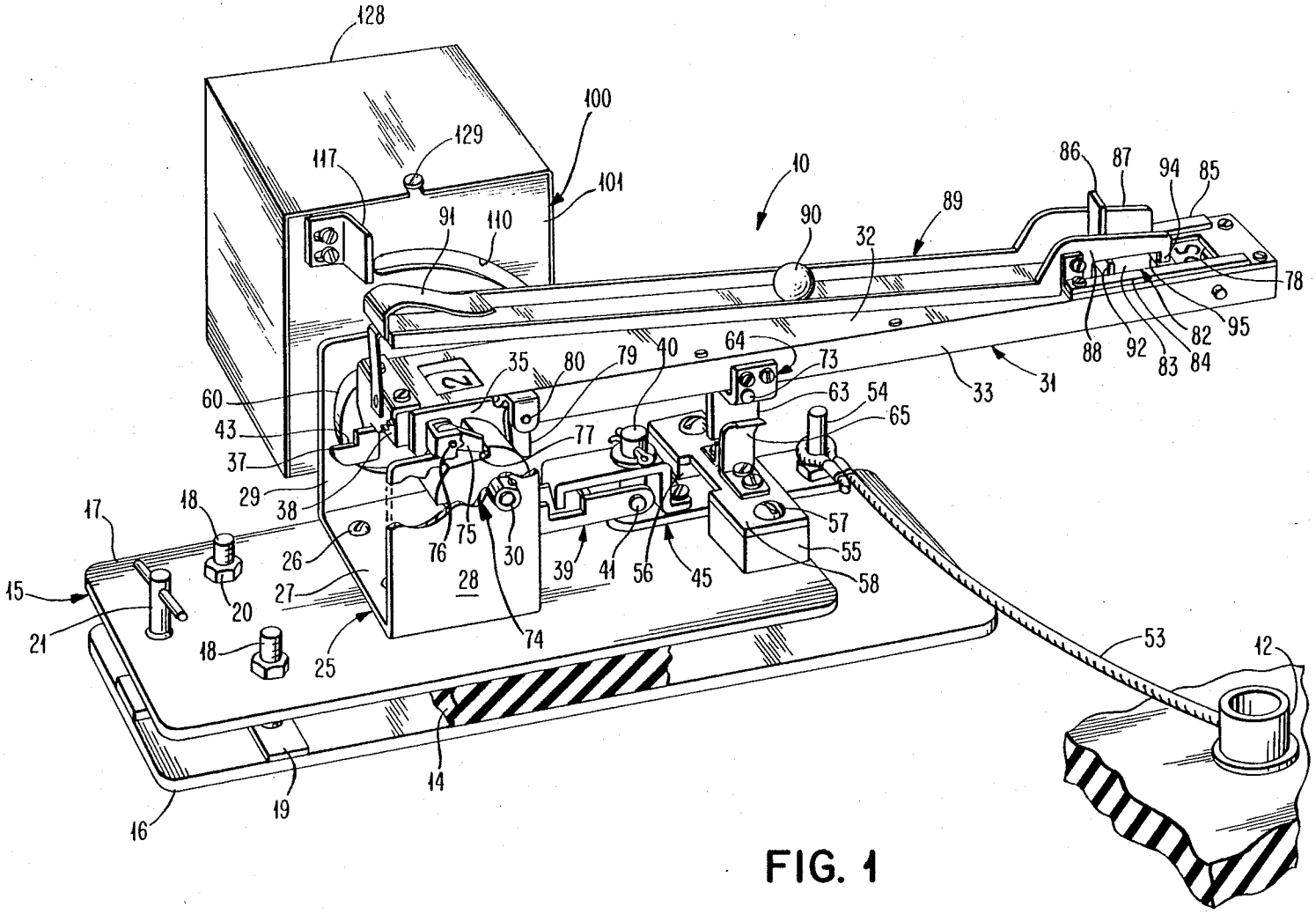
FIG. 1 is a perspective view of an indicating device of the present invention in its indicating position after a golf ball has been struck.
Figures 3, 10:
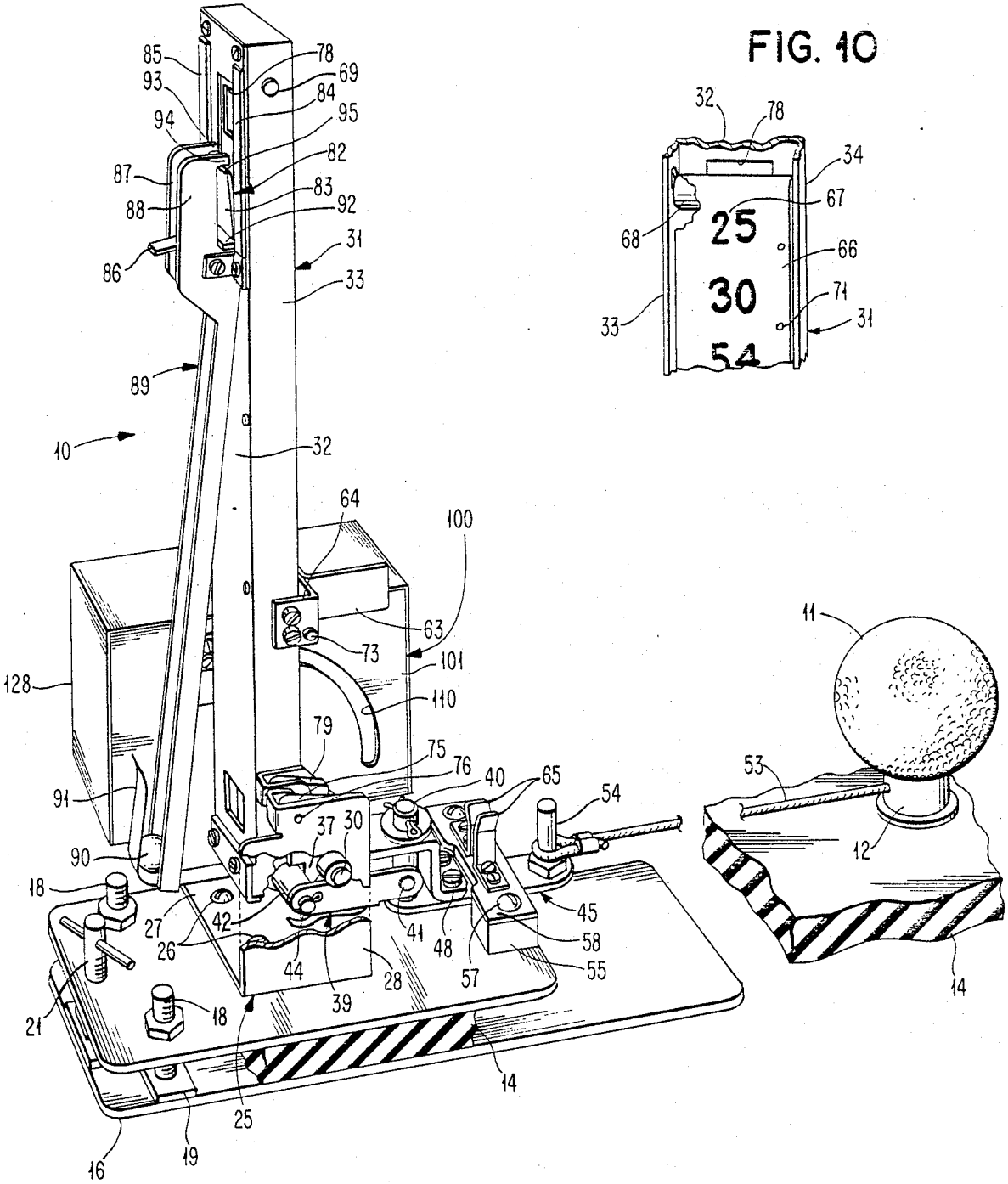
FIG. 3 is a perspective view of the indicating device of FIG. 1 in its inactive position in which a ball is disposed on a tee prior to being struck and showing the relationship between various elements of the indicating device.
Figure 9:
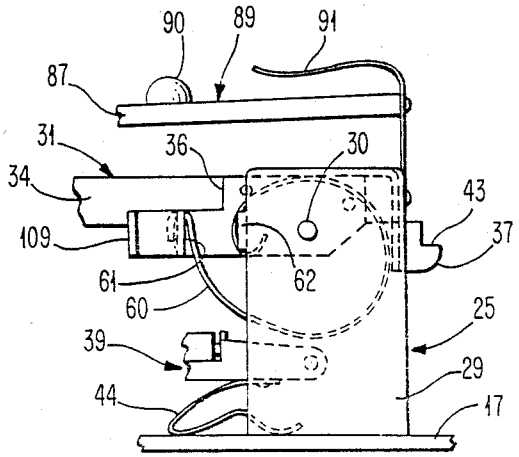

FIG. 9 is a fragmentary side elevational view of a portion of the indicating device of FIG. 1 with the main arm or lever in its indicating position and showing the torsion spring for advancing the main arm or lever from its inactive position to its indicating position; and FIG. 10 is a fragmentary elevational view of a portion of the main arm in its inactive position and showing an indicator for viewing.

Referring to the drawings and particularly FIG. 1, there is shown an indicating device 10 of the present invention for enabling a golfer to know whether eye contact is maintained with a ball impact area when striking a golf ball 11 (see FIG. 3) disposed on a tee 12 with a golf club head. The indicating device 10 is releasably mounted on a mat 14 (see FIG. 1) by a clamp 15 which includes a lower jaw 16 for disposition beneath the mat 14 and an upper jaw 17 for disposition above the mat 14.

A pair of screws 18 extends upwardly from a plate 19 fixed to the upper surface of the lower jaw 16 and through openings in the upper jaw 17. Th screws 18 have nuts 20 cooperating therewith to adjust the spacing between the lower jaw 16 and the upper jaw 17 in accordance with the thickness of the mat 14. A clamp locking screw 21 clamps the upper jaw 17 to the lower jaw 16 with the mat 14 therebetween.

The clamp locking screw 21 has its bottom end disposed within an alignment hole in a plate 22 (see FIG. 2) fixed to the upper surface of the lower jaw 16. A nut 23 is threaded on the clamp locking screw 21 between the bottom surface of the upper jaw 17 and a plate 24 supported from the bottom surface of the upper jaw 17 in spaced relation to the bottom surface of the upper jaw 17 in the area of the nut 23. Accordingly, when the clamp locking screw 21 is tightened, the upper jaw 17 is retained between the nut 23 and the nuts 20 and the mat 14 is clamped between the lower jaw 16 and the upper jaw 17.

A U-shaped support bracket 25 (see FIG. 1) is mounted on the upper surface of the upper jaw 17 of the clamp 15 by screws 26 extending through holes in a base 27 of the U-shaped support bracket 25 and into threaded holes in the upper jaw 17. The U-shaped support bracket 25 has a pair of parallel legs 28 and 29 extending upwardly therefrom substantially perpendicular thereto and substantially parallel to each other. A pivot shaft 30 is rotatably supported in the legs 28 and 29 of the U-shaped bracket 25.

Figure 8:
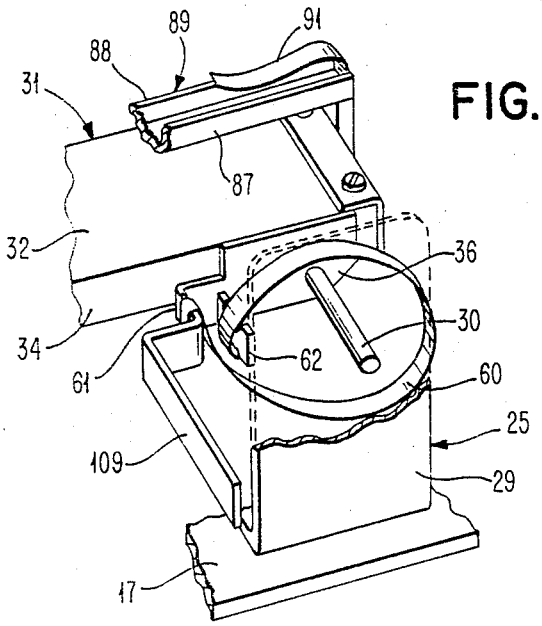
FIG. 8 is a fragmentary perspective view of a portion of the indicating device of FIG. 1 with its main arm or lever in its indicating position and showing a torsion spring for advancing the main arm or lever from its inactive position to its indicating position.

A main arm or lever 31 includes a top wall 32 and side walls 33 and 34 (see FIG. 8) substantially perpendicular to the top wall 32 and substantially parallel to each other to form a U-shaped configuration. The side walls 33 (see FIG. 1) and 34 (see FIG. 9) of the main arm 31 have side plates 35 (see FIG. 1) and 36 (see FIG. 9), respectively, depending therefrom and journaled on the pivot shaft 30 to rotatably support the main arm 31 on the pivot shaft 30. Accordingly, the main arm 31 may be pivotally moved in a vertical plane from its inactive or cocked position of FIG. 3 to its indicating position of FIGS. 1, 2, 8, and 9. The main arm 31 is substantially horizontal in its indicating position and substantially vertical in its inactive position.

Figure 5:
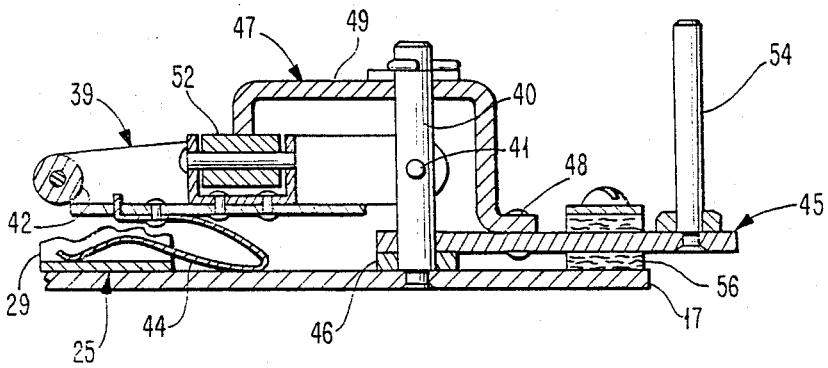
FIG. 5 is a fragmentary sectional view, partly in elevation, of the latching and releasing mechanisms of FIG. 4 and taken along line 5—5 of FIG. 4.

The main arm 31 is held in its inactive position by a catch 37 (see FIG. 1), which is attached to the top wall 32 of the main arm 31 and abuts a rear wall 38 of the main arm 31, engaging a latch 39 as shown in FIG. 3. The latch 39 is pivotally mounted on a support post 40, which extends upwardly from the upper clamp jaw 17, by a pivot pin 41 (see FIG. 5). The latch 39 includes a roller 42, which engages a portion 43 (see FIG. 2) of the catch 37. A spring 44 (see FIG. 5) continuously urges the latch 39 clockwise about the pivot pin 41 to urge the latch 39 to its latching position in which the roller 42 engages the portion 43 (see FIG. 2) of the catch 37 to hold the main arm 31 in its inactive position of FIG. 3.

The latch 39 is moved counterclockwise (as viewed in FIG. 5) about the pivot pin 41 by a trip arm 45 being pivoted about the support post 40 on which the trip arm 45 is rotatably supported. A spacer 46 holds the trip arm 45 in spaced relation to the upper surface of the upper clamp jaw 17.

Figure 6:
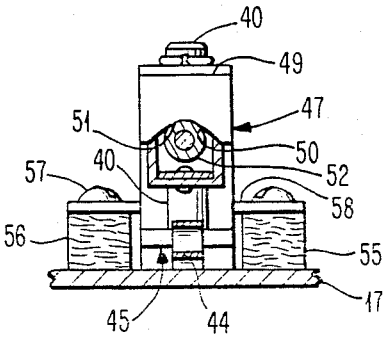
FIG. 6 is a fragmentary sectional view, partly in elevation, of the latching and releasing mechanisms of FIG. 4 and taken along line 6—6 of FIG. 4.

The trip arm 45 has a cam support 47 fixed thereto by screws 48. The cam support 47 includes a substantially horizontal portion 49, which is rotatably supported on the support post 40. The free end of the cam support 47 has a pair of cam surfaces 50 (see FIG. 6) and 51 for cooperation with a cam follower 52, which is a roller supported by the latch 39 (see FIG. 5).

Figure 4:
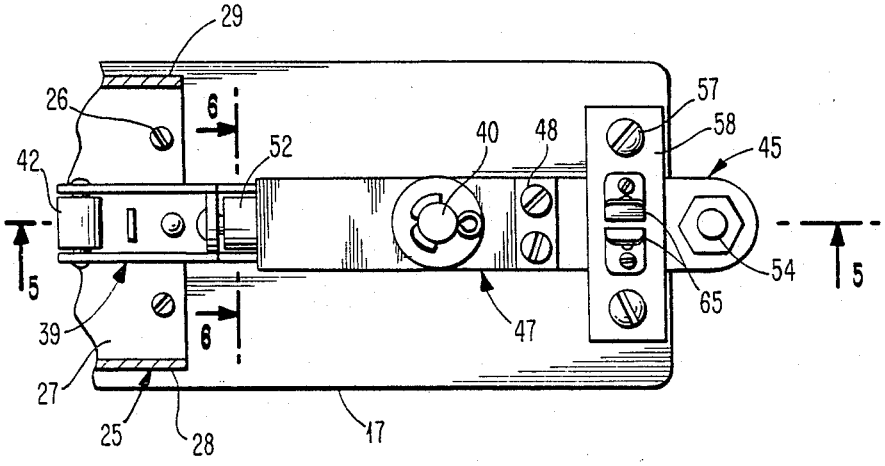
FIG. 4 is a top plan view of a portion of the indicating device of FIG. 1 and showing a latching mechanism for maintaining a main arm or lever in its inactive position and a releasing mechanism for releasing the latching mechanism when a ball is struck.

The trip arm 45 has the tee 12 (see FIG. 1) connected thereto through a flexible cord 53 being rotatably connected to an upstanding post 54 on one end of the trip arm 45. Accordingly, when the ball 11 (see FIG. 3) on the tee 12 is struck by a right handed golfer, the trip arm 45 is rotated clockwise (as viewed in FIG. 4) about the support post 40 so that the cam surface 50 (see FIG. 6) on the cam support 47 engages the cam follower 52 to move the latch 39 (see FIG. 5) counterclockwise about the pivot pin 41 and against the force of the spring 44 so that the roller 42 on the latch 39 is moved downwardly and ceases to engage the portion 43 (see FIG. 1) of the catch 37 on the main arm 31 whereby the main arm 31 is no longer held in its inactive or cocked position of FIG. 3.

When the indicating device 10 is mounted on the mat 14 for use by a left handed golfer, the trip arm 45 is pivoted counterclockwise (as viewed in FIG. 4) about the support post 40 when the ball 11 (see FIG. 3) on the tee 12 is struck. This results in the cam surface 51 (see FIG. 6) of the cam support 47 engaging the cam follower 52. This causes the latch 39 (see FIG. 5) to pivot counterclockwise about the pivot pin 41 against the force of the spring 44 to cause the roller 42 to cease to engage the portion 43 (see FIG. 2) of the catch 37 on the main arm 31.

When the trip arm 45 is pivoted clockwise (as viewed in FIG. 4) about the support post 40 by a right handed golfer striking the ball 11 (see FIG. 3) on the tee 12, the trip arm 45 engages a resilient block 55 (see FIG. 6) of rubber or other elastomeric material. When the trip arm 45 (see FIG. 4) is pivoted counterclockwise about the support post 40 by a left handed golfer striking the ball 11 (see FIG. 3) on the tee 12, the trip arm 45 engages a resilient block 56 (see FIG. 6), which is the same as the resilient block 55. The resilient blocks 55 and 56 are mounted on the upper clamp jaw 17 (see FIG. 2) by screws 57, which also attach a plate 58 to the upper clamp jaw 17 through the resilient blocks 55 and 56.

Figure 2:
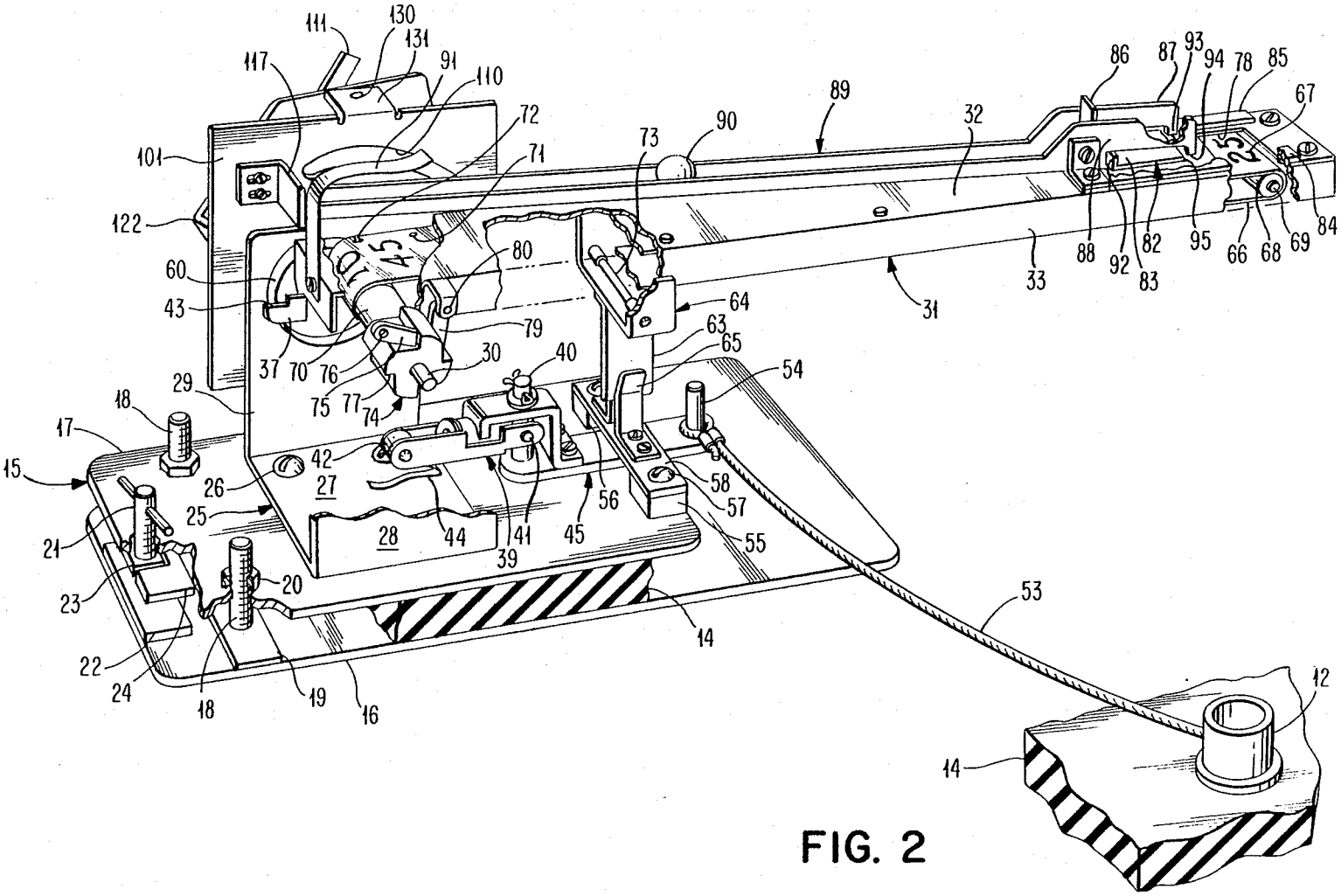
FIG. 2 is a perspective view, similar to FIG. 1, but having parts broken away to show relationships between various elements of the indicating device.

When the portion 43 of the catch 37 on the main arm 31 is released from the latch 39 by pivoting of the trip arm 45, the main arm 31 is advanced from its inactive or vertical position of FIG. 3 to its indicating position of FIG. 2 by a power torsion spring 60, which is preloaded when the main arm 31 is returned to its inactive position of FIG. 3 from its indicating position of FIG. 2. The torsion spring 60 has one end fixed to a flange 61 (see FIG. 9) on the side plate 36 of the main arm 31 and its other end fixed to a flange 62 on the leg 29 of the U-shaped support bracket 25. The torsion spring 60 accelerates the main arm 31 from its inactive position of FIG. 3 to its indicating position of FIGS. 1 and 2 when the catch 37 is no longer held by the latch 39.

The advancement of the main arm 31 by the torsion spring 60 is stopped when a blade 63, which is fixed to the main arm 31 by a U-shaped support 64, enters between a pair of upstanding friction shoes 65 (see FIG. 4), which are fixed to the plate 58. The resilient blocks.55 (see FIG. 6) and 56 absorb a portion of this energy resulting from the friction shoes 65 (see FIG. 4) stopping the main arm 31 (see FIG. 2) in its indicating position.

The main arm 31 has an endless tape 66 with indicators 67, which are randomly selected numbers, spaced at a selected distance from each other along the entire length of the endless tape 66. The indicators 67 may be any other suitable indicators other than numbers such as letters, different colors, or various shaped geometrical elements, for example.

The endless tape 66 is rotatably mounted on a drum 68 adjacent the free end of the main arm 31. The drum 68 is rotatably supported on a shaft 69, which is mounted in the side walls 33 and 34 (see FIG. 9) of the main arm 31.

The endless tape 66 (see FIG. 2) also is passed around a drum 70, which is fixed to the pivot shaft 30 for rotation therewith. The endless tape 66 has holes 71 formed therein on one side of each of the indicators 67 to receive guide pins 72 on the drum 70 for cooperation therewith. This insures a positive engagement between the endless tape 66 and the drum 70.

The drum 70 is substantially larger than the drum 68. The U-shaped support 64 has a guide rod 73 to guide the bottom of the endless tape 66 in its translation between the different sized drums 68 and 70.

The pivot shaft 30 also has a ratchet wheel 74 fixed thereto for rotation therewith. When the main arm 31 is rotated from its indicating position of FIG. 2 to its inactive position of FIG. 3, an indexing pawl 75 (see FIG. 2), which is pivotally mounted on the leg 28 of the U-shaped support 25 by a pivot pin 76, engages one of a plurality of ratchet teeth 77 on the ratchet wheel 74. This holds the ratchet wheel 74, the pivot shaft 30, and the drum 70 stationary so that the main arm 31 rotates about the axis of the stationary pivot shaft 30. This causes the endless tape 66 to advance with respect to the main arm 31 to move another of the indicators 67 into alignment with an opening or window 78 in the top wall 32 of the main arm 31 when the main arm 31 is returned to its inactive position of FIG. 3.

To insure that the indicator 67 (see FIG. 2), which has been advanced to the opening 78 when the main arm 31 is moved to its inactive position of FIG. 3, remains in this position when the main arm 31 returns to its indicating position of FIG. 2, a locking pawl 79 (see FIG. 1), which is pivotally mounted on the side plate 35 of the main arm 31 by a pivot pin 80, engages one of the ratchet teeth 77 (see FIG. 2) on the ratchet wheel 74. Therefore, with the locking pawl 79 engaging one of the ratchet teeth 77 on the ratchet wheel 74, the ratchet wheel 74, the pivot shaft 30, and the drum 70 rotate with the main arm 31 during its rotation from its inactive position of FIG. 3 to its indicating position of FIG. 2 to maintain the endless tape 66 against movement.

Accordingly, when the main arm 31 reaches its indicating position of FIG. 2, one of the indicators 67 on the endless tape 66 is viewed by the golfer through the opening 78 in the top wall 32 of the main arm 31. The opening 78 in the top wall 32 of the main arm 31 is vertically aligned with the location of the tee 12 when the tee 12 is positioned with the ball 11 (see FIG. 3) thereon. Thus, the golfer is looking at the ball impact area when striking the ball 11, and the opening 78 (see FIG. 2) in the top wall 32 of the main arm 31 is on the same eye contact line from the golfer to the tee 12 when the main arm 31 pivots to its indicating position of FIG. 2.

The opening 78 is blocked by a slide 82 being moved over the opening 78 a short selected period of time after the main arm 31 has pivoted to its indicating position of FIG. 2. The slide 82 has a cover portion 83 disposed between a pair of parallel guides 84 (see FIG. 1) and 85, which are fixed to the top wall 32 of the main arm 31.

The slide 82 has a tab 86 riding between walls 87 and 88 of a U-shaped trough 89 and guided thereby. The U-shaped trough 89 is inclined upwardly towards the pivot end of the main arm 31 and is secured to the main arm 31.

The U-shaped trough 89 has a ball 90 rolling therein. When the main arm 31 is in its inactive position of FIG. 3, the ball 90 rests between the U-shaped trough 89 and a retainer 91, which stops the motion of the ball 90 along the U-shaped trough 89 when the main arm 31 is moved to its inactive position of FIG. 3. When the main arm 31 pivots from its inactive position of FIG. 3 to its indicating position of FIG. 2, the ball 90 rolls along the inclined U-shaped trough 89 until the ball 90 strikes the tab 86 of the slide 82. This causes the cover portion 83 of the slide 82 to block the opening 78 in the top wall 32 of the main arm 31.

The advancement of the slide 82 by the ball 90 is stopped when end flanges 92, which are in the same plane as the tab 86 and exterior of the walls 87 and 88 of the U-shaped trough 89, on the slide 82 engage stop fingers 93 and 94 at the ends of the walls 87 and 88, respectively, of the U-shaped trough 89. The stop fingers 93 and 94 engage an end 95 of the cover portion 83 of the slide 82 when the main arm 31 is pivoted to its inactive position of FIG. 3.

When the main arm 31 is in its inactive position of FIG. 3, the slide 82 tilts about the end flanges 92 to move the end surface 95 towards the walls 87 and 88 of the U-shaped trough 89. The tab 86 on the slide 82 insures that the slide 82 tilts about the end flanges 92. This enables the stop fingers 93 and 94 to momentarily retain the slide 82 from moving to its blocking position of the opening 78 when the main arm 31 is driven by the torsion spring 60 to its indicating position of FIG. 2 after the latch 39 has ceased to engage the portion 43 of the catch 37. Without this retaining arrangement, the slide 82 would move to its blocking position of the opening 78 in the top wall 32 of the main arm 31 as a result of the force created when the main arm 31 pivots to its indicating position of FIG. 2. However, the cover portion 83 of the slide 82 is not retained by the stop fingers 93 and 94 when the ball 90 strikes the tab 86 of the slide 82.

The inclination of the U-shaped trough 89 controls the selected time period during which the opening 78 is not blocked by the cover portion 83 of the slide 82. Thus, a greater inclination of the U-shaped trough 89 would decrease the period of time that the opening 78 is not blocked by the cover portion 83 of the slide 82 and a lesser inclination of the U-shaped trough 89 would increase the time that the indicator 67 within the opening 78 in the top wall 32 of the main arm 31 could be viewed by the golfer.

Considering the operation of the indicating device 10 of the present invention, the torsion spring 60 is preloaded when the main ar 31 is disposed in its inactive position of FIG. 3. The flexible cord 53 is pulled taut, and the tee 12 is placed on the mat 14 with the ball 11 disposed on the tee 12. When the flexible cord 53 is taut toward the golfer and in line with the main arm 31 when the main arm 31 is in its indicating position of FIG. 2, the length of the flexible cord 53 is such that the tee 12 is in a position directly below the opening 78 in the top wall 32 of the main arm 31 when the main arm 31 is in its indicating position of FIG. 2. Thus, the ball 11 (see FIG. 3) and the opening 78 (see FIG. 2) have essentially the same position so as to have the same eye contact line with the golfer.

With the main arm 31 in its inactive position of FIG. 3 and the golf ball 11 on the tee 12, the golf ball 11 and the tee 12 are struck by a golf club head swung by a right-handed golfer. This causes the trip arm 45 to pivot clockwise (as viewed in FIG. 4) about the support post 40 to release the latch 39 from the portion 43 (see FIG. 2) of the catch 37 on the main arm 31. This release of the latch 39 results in the preloaded torsion spring 60 rapidly accelerating the main arm 31 about the pivot shaft 30 to its indicating position of FIG. 2 where it is abruptly stopped by the blade 63 entering between the pair of the friction shoes 65 (see FIG. 4).

The indicator 67 (see FIG. 2) on the endless tape 66 is viewable through the opening 78 in the top wall 32 of the main arm 31 momentarily after the main arm 31 reaches its indicating position of FIG. 2. Then, the slide 82 is moved by the ball 90 so that the cover portion 83 of the slide 82 blocks the opening 78 to prevent further viewing of the indicator 67 on the endless tape 66.

The golfer now attempts to recall the indicator 67, which was momentarily displayed through the opening 78. The main arm 31 is then returned to its inactive position of FIG. 3 during which another of the indicators 67 (see FIG. 2) on the endless tape 66 is advanced into position at the opening 78 in the top wall 32 of the main arm 31. The indicator 67, which was at the opening 78 when the golf ball 11 (see FIG. 3) was struck, is now on the underside of the endless tape 66 (see FIG. 10) at the free end of the main arm 31 and in full view of the golfer with the main arm 31 in its inactive position of FIG. 3. Thus, the golfer can ascertain if the indicator 67 (see FIG. 10) was viewed at the time that the golfer struck the golf ball 11 (see FIG. 3) so that the golfer will know that eye contact was maintained with the ball impact area until after the golf ball 11 was struck.

The ball 90 returns within the retainer 91 when the main arm 31 is pivoted to its inactive position of FIG. 3. The slide 82 returns to its tilted position in which it is temporarily locked by the stop fingers 93 and 94 on the walls 87 and 88, respectively, of the U-shaped trough 89. Then, the golfer may again pull the flexible cord 53 taut and place another of the golf balls 11 on the tee 12 to be struck.

Figure 7:
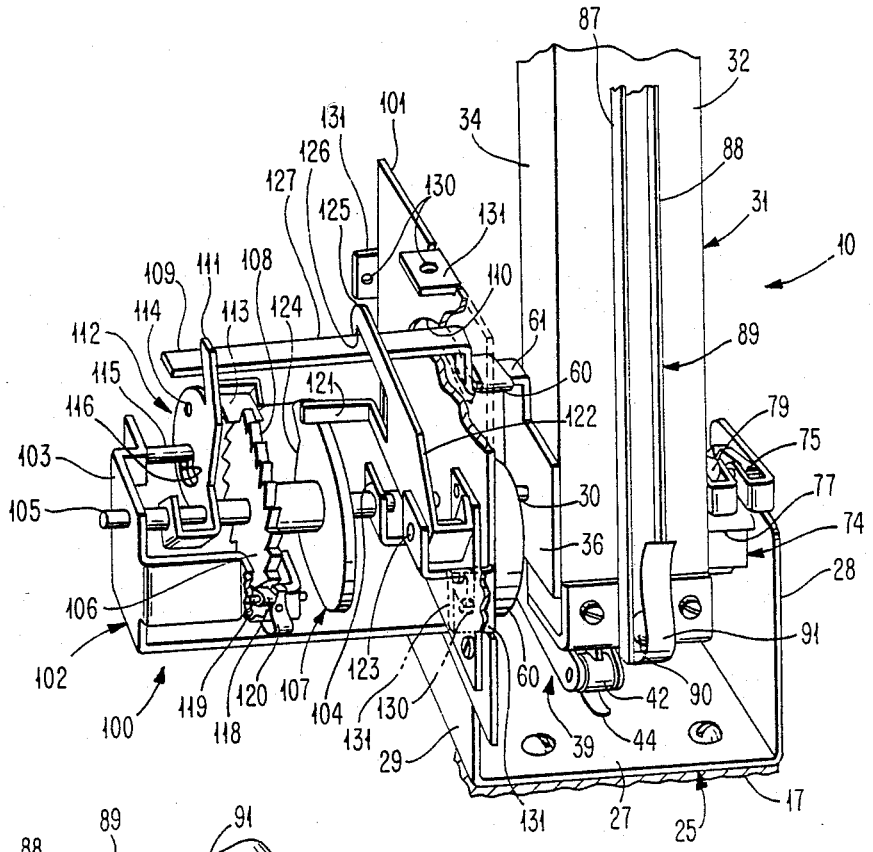
FIG. 7 is a fragmentary perspective view of a portion of the indicating device of FIG. 1 with the main arm or lever in an intermediate position and showing a counting and locking mechanism for use with the indicating device.

If desired, a counting and locking mechanism 100 (see FIG. 7) may be utilized with the indicating device 10. This would permit a specific number of movements of the main arm 31 to its inactive position of FIG. 3 from its indicating position of FIG. 2 before locking the main arm 31 in its inactive position of FIG. 3. Accordingly, the counting and locking mechanism 100 (see FIG. 7) would require insertion of a coin into a coin controlled mechanism, for example, to enable further use of the indicating device 10.

The counting and locking mechanism 100 includes a mounting plate 101 attached to the leg 29 of the U-shaped support bracket 25. The mounting plate 101 has a ratchet shaft support 102 mounted thereon.

The ratchet shaft support 102 has vertical portions 103 and 104 to rotatably support a ratchet shaft 105. The ratchet shaft 105 has a ratchet wheel 106 connected thereto for rotation therewith. The ratchet shaft 105 also has a cam plate 107 fixed thereto for rotation therewith.

The ratchet wheel 106 is rotated an angular distance equal to that between two of its adjacent teeth 108 each time that the main arm 31 is returned to its inactive position of FIG. 3 from its indicating position of FIG. 2. When the main arm 31 is moved to its inactive position of FIG. 3, a ratchet actuating arm 109 (see FIG. 7), which is secured to the flange 61 on the side plate 36 and extends through an arcuate slot 110 in the mounting plate 101, engages a finger 111 on a ratchet actuating lever 112, which is rotatably supported on the ratchet shaft 105. The ratchet actuating lever 112 has a drive pawl 113, which is pivotally mounted thereon by a pivot pin 114, for engaging one of the teeth 108 on the ratchet wheel 106 to rotate the ratchet wheel 106 the angular distance between two of the adjacent teeth 108.

The maximum amount of motion of the ratchet actuating lever 112 is limited by a stud 115, which is mounted on the ratchet shaft support 102 and extends through a slot 116 in the ratchet actuating lever 112. The length of the slot 116 insures that the ratchet wheel 106 can be advanced only the angular distance between two of the adjacent teeth 108 on the ratchet wheel 106 each time that the main arm 31 is returned to its inactive position of FIG. 3. The maximum movement of the ratchet actuating arm 109 (see FIG. 7) as the main arm 31 is returned to its inactive position of FIG. 3 is limited by a stop 117 (see FIG. 2), which is mounted on the mounting plate 101, engaging the ratchet actuating arm 109 (see FIG. 7).

The ratchet wheel 106 is held in the position to which it is advanced by a detent pawl 118, which is pivotally mounted on the ratchet shaft support 102 by a pivot pin 119. A leaf spring 120, which also is mounted on the ratchet shaft support 102, continuously urges the detent pawl 118 into engagement with one of the ratchet teeth 108 on the ratchet wheel 106 to prevent any rotation of the ratchet wheel 106 in the opposite direction.

Each advancement of the ratchet wheel 106 by the ratchet actuating arm 109 also causes the same amount of rotation of the cam plate 107. The cam plate 107 has a finger 121 of a locking arm 122 riding on its cam surface. The locking arm 122 is pivotally mounted on the mounting plate 101 by a pivot pin 123. When the finger 121 falls onto a dwell portion 124 of the cam plate 107, the locking arm 122 pivots counterclockwise about the pivot pin 123 so that a locking finger 125 has a locking edge 126 fall beyond a surface 127 of the ratchet actuating arm 109. This prevents the ratchet actuating arm 109 from moving thereafter so that the main arm 31 cannot be pivoted from its inactive position of FIG. 3.

To again move the main arm 31 to its indicating position of FIG. 2, the ratchet shaft 105 (see FIG. 7) must then be rotated sufficiently to enable the finger 121 on the locking arm 122 to be removed from the dwell portion 124 on the cam plate 107. This may be accomplished through the golfer inserting a coin into a coil controlled mechanism (not shown) connected to the ratchet shaft 105.

It should be understood that a cover 128 (see FIG. 1) is placed over the counting and locking mechanism 100 and secured thereto by screws 129 extending into threaded holes 130 (see FIG. 7) in brackets 131 on the mounting plate 101. This prevents access to the ratchet shaft 105.

While the indicating device 10 of the present invention has been shown and described as being utilized with a golfer striking the golf ball 11 (see FIG. 3), it should be understood that the indicating device 10 may be utilized wherever a ball is to be struck and the head of the person striking the ball is to maintain eye contact with the ball impact area until after the ball is struck. For example, a football kicker could utilize the indicating device 10 with the tee 12 being replaced by a football kicking tee.

While the indicating device 10 of the present invention has been shown and described as being utilized with the mat 14 (see FIG. 1), it should be understood that the indicating device 10 could be disposed on the ground as long as it was prevented from being moved. For example, the lower clamping jaw 16 would be omitted, and the upper clamping jaw 17 would have a plurality of holes therein to receive retaining pins inserted into the ground.

While the main arm 31 has been shown and described as being pivotally mounted, it should be understood that the main arm 31 can be moved from an inactive position to an indicating position and returned to its inactive position by other than pivoting. For example, the main arm 31 could be slidably mounted.

An advantage of this invention is that it is a mechanical device requiring no power supply. Another advantage of this invention is that it may be used with either a right or left handed golfer. A further advantage of this invention is that it may be used to insure that a person striking a ball at a fixed position maintains eye contact with the ball impact area until after the ball is struck. Still another advantage of this invention is that the time period for viewing an indicator is selectively controlled.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A device for indicating to a person striking a ball at a fixed position that eye contact was maintained at the fixed position until after the ball is struck including:

ball support means for supporting a ball to be struck at the fixed position;

movable means mounted for movement between an inactive position and an indicating position;

advancing means for advancing said movable means from its inactive position to its indicating position in response to movement of said ball support means when a ball on said ball support means is struck;

said movable means having disposing means including a plurality of different indicators for disposing one of said plurality of different indicators for viewing at a viewable position, adjacent the fixed position, by the person striking a ball on said ball support means when said movable means is moved to its indicating position;

control means supported by said movable means for controlling the period of time that the one disposed indicator can be viewed at the viewable position by the person striking a ball on said ball support means so that the person cannot view the one disposed indicator unless eye contact is maintained at the fixed position until after striking a ball on said ball support means;

and moving means for moving said disposing means of said movable means to a position in which the one disposed indicator previously disposed at the viewable position may be viewed when said movable means is returned to its inactive position from its indicating position.

2. The device according to claim 1 in which:

said disposing means of said movable means includes an endless tape having said plurality of different indicators thereon at a selected spaced distance from each other, said endless tape being supported by said movable means;

and said moving means for moving said disposing means of said movable means includes means for advancing said endless tape the selected spaced distance between adjacent of said plurality of different indicators each time that said movable means is returned from its indicating position to its inactive position.

3. The device according to claim 2 in which said control means includes means movably supported on said movable means.

4. The device according to claim 3 in which:

said movable means has an opening to enable viewing of the one disposed indicator of said plurality of different indicators on said endless tape when said movable means is in its indicating position;

said movably supported means of said control means includes blocking means to block said opening in said movable means;

and said control means includes causing means for causing said blocking means to block said opening in said movable means a selected period of time after said movable means has moved to its indicating position.

5. The device according to claim 4 including:

latching means for latching said movable means in its inactive position;

releasing means for releasing said latching means in response to a ball being struck at the fixed position;

and said advancing means advancing said movable means from its inactive position to its indicating position when said latching means is released by said releasing means.

6. The device according to claim 5 including stopping means for stopping said movable mean at its indicating position and absorbing the force of said movable means when said movable means moves from its inactive position to its indicating position.

7. The device according to claim 6 in which said control means includes means for selectively changing the period of time that said opening in said movable means is open prior to said causing means causing said blocking means to block said opening in said movable means.

8. The device according to claim 7 including means for slidably supporting said blocking means on said movable means.

9. The device according to claim 1 including:

latching means for latching said movable means in its inactive position;

releasing means for releasing said latching means in response to a ball being struck at the fixed position;

and said advancing means advancing said movable means from its inactive position to its indicating position when said latching means is released by said releasing means.

10. A device for indicating to a person striking a ball at a fixed position that eye contact was maintained at the fixed position until after the ball is struck including:

ball support means for supporting a ball to be struck at the fixed position;

pivotally mounted means mounted for movement between an inactive position and an indicating position;

advancing means for advancing said pivotally mounted means from its inactive position to its indicating position in response to movement of said ball support means when a ball on said ball support means is struck by the person;

said pivotally mounted means having disposing means including a plurality of different indicators for disposing one of said plurality of different indicators for viewing at a viewable position, adjacent the fixed position, by the person striking a ball on said ball support means when said pivotally mounted means is moved to its indicating position;

control means supported by said pivotally mounted means for controlling the period of time that the one disposed indicator can be viewed at the viewable position by the person striking a ball on said ball support means so that the person cannot view the one disposed indicator unless eye contact is maintained at the fixed position until after striking a ball on said ball support means;

and moving means for moving said disposing means of said pivotally mounted means to a position in which the one disposed indicator previously disposed at the viewable position may be viewed when said pivotally mounted means is returned to its inactive position from its indicating position.

11. The device according to claim 10 in which:

said disposing means of said pivotally mounted means includes an endless tape having said plurality of different indicators thereon at a selected spaced distance from each other, said endless tape being supported by said pivotally mounted means;

and said moving means for moving said disposing means of said pivotally mounted means includes means for advancing said endless tape for the selected spaced distance between adjacent of said plurality of different indicators each time that said pivotally mounted means is returned from its indicating position to its inactive position.

12. The device according to claim 11 in which said control means includes means movably supported on said pivotally mounted means.

13. The device according to claim 12 in which:

said pivotally mounted means has an opening to enable viewing of the one disposed indicator of said plurality of different indicators on said endless tape when said pivotally mounted means is in its indicating position;

said movably supported means of said control means includes blocking means to block said opening in said pivotally mounted means;

and said control means includes causing means for causing said blocking means to block said opening in said pivotally mounted means a selected period of time after said pivotally mounted means has moved to its indicating position.

14. The device according to claim 13 including:

latching means for latching said pivotally mounted means in its inactive position;

releasing means for releasing said latching means in response to a ball being struck at the fixed position;

and said advancing means advancing said pivotally mounted means from its inactive position to its indicating position when said latching means is released by said releasing means.

15. The device according to claim 14 including stopping means for stopping said pivotally mounted means at its indicating position and absorbing the force of said pivotally mounted means when said pivotally mounted means moves from its inactive position to its indicating position.

16. The device according to claim 15 in which said control means includes means for selectively changing the period of time that said opening in said pivotally mounted means is open prior to said causing means causing said blocking means to block said opening in said pivotally mounted means.

17. The device according to claim 16 including means for slidably supporting said blocking means on said pivotally mounted means.

18. The device according to claim 10 including:

latching means for latching said pivotally mounted means in its inactive position;

releasing means for releasing said latching means in response to a ball being struck at the fixed position;

and said advancing means advancing said pivotally mounted means from its inactive position to its indicating position when said latching means is released by said releasing means.

* * * * *